US008375868B2

(12) United States Patent
Baranowski et al.

(10) Patent No.: US 8,375,868 B2
(45) Date of Patent: Feb. 19, 2013

(54) HATCH COVER LATCHING SYSTEM METHOD AND APPARATUS

(75) Inventors: Kenneth M. Baranowski, Albion, IN (US); Arturo Machado, Elkhart, IN (US); Roy J. Huber, Goshen, IN (US); Eric J. Johanson, Granger, IN (US)

(73) Assignee: United Railcar Covers LLC, Ligonier, IN (US)

( * ) Notice: Subject to any disclaimer, the term of this patent is extended or adjusted under 35 U.S.C. 154(b) by 307 days.

(21) Appl. No.: 12/843,951

(22) Filed: Jul. 27, 2010

(65) Prior Publication Data

US 2012/0024190 A1 Feb. 2, 2012

(51) Int. Cl.
*B61D 39/00* (2006.01)

(52) U.S. Cl. ..... 105/377.11; 105/377.01; 105/377.07; 105/377.09

(58) Field of Classification Search ..... 105/377.01, 105/377.07, 377.09, 377.11
See application file for complete search history.

(56) References Cited

U.S. PATENT DOCUMENTS

| | | | | |
|---|---|---|---|---|
| 3,260,224 | A * | 7/1966 | Pettit et al. | 105/377.11 |
| 3,552,324 | A * | 1/1971 | Schilf et al. | 105/377.11 |
| 3,628,828 | A * | 12/1971 | Page et al. | 49/381 |
| 3,800,714 | A * | 4/1974 | Stark et al. | 105/377.11 |
| 3,854,771 | A * | 12/1974 | Anderson | 296/100.04 |
| 4,524,700 | A * | 6/1985 | Engdahl | 105/377.09 |
| 4,613,174 | A * | 9/1986 | Berg et al. | 292/136 |
| 4,678,225 | A * | 7/1987 | Ritzl et al. | 296/185.1 |
| 4,985,962 | A * | 1/1991 | Weber | 16/232 |
| 5,311,824 | A * | 5/1994 | Sauer et al. | 105/377.01 |
| 5,697,121 | A * | 12/1997 | Early | 16/231 |
| 7,264,296 | B1 * | 9/2007 | Maney et al. | 296/100.02 |
| 7,878,124 | B2 * | 2/2011 | Low et al. | 105/377.05 |
| 8,051,779 | B2 * | 11/2011 | Baranowski et al. | 105/377.09 |
| 2008/0236439 | A1 * | 10/2008 | Low et al. | 105/377.05 |
| 2010/0326318 | A1 * | 12/2010 | Baranowski et al. | 105/377.01 |
| 2011/0265684 | A1 * | 11/2011 | Knight et al. | 105/377.06 |
| 2012/0024190 | A1 * | 2/2012 | Baranowski et al. | 105/377.11 |

FOREIGN PATENT DOCUMENTS

| | | | |
|---|---|---|---|
| JP | 53020212 | A * | 2/1978 |
| JP | 2005349852 | A * | 12/2005 |

* cited by examiner

*Primary Examiner* — Jason C Smith
(74) *Attorney, Agent, or Firm* — Taylor IP, P.C.

(57) ABSTRACT

A railcar hatch cover latching system including a sliding mechanism attached to a movable portion of the hatch cover and a latching apparatus associated with the hatch cover. The latching apparatus has a biased assembly, a bar and at least one profiled stop. The bar extends through the biased assembly. The biased assembly is configured to allow the bar to pass through the biased assembly with a first force requirement. The at least one profiled stop is positioned on the bar to encounter the biased assembly and having a second force requirement to move the bar past the at least one profiled stop, the second force being greater than the first force.

14 Claims, 7 Drawing Sheets

HATCH COVER LATCHING SYSTEM METHOD AND APPARATUS

BACKGROUND OF THE INVENTION

1. Field of the Invention

The present invention relates to a hatch latching system, and, more particularly, to a hatch latching system for a slideable hatch.

2. Description of the Related Art

Bulk cargo carrying railroad cars often have openings along the top that are opened for the loading of materials and closed for transportation. Many bulk cargo railroad cars are utilized without any cover system. It is desirous to protect the materials carried in the interior of the railroad car from damage, which may be caused by weather or other environmental sources, such as particulate or biological material contained in the air. It is also desirous to prevent the bulk material from being dissipated by transportation due to the movement of air over the bulk material while it is in transit.

During the filling of the railcar, it is desirable to have the top of the railcar open so as to provide an easy way of loading the bulk material cargo from a delivering device, such as an overhead hopper. It is known to have railroad car hatches that are hinged and which are opened by releasing the latches on one side and pivoting the covers to the other side, thereby exposing a portion of the top of the railroad car so that the bulk cargo material may be loaded therein. It is also known to utilize latch systems that require the connection of the hatch to the framework or other structural elements surrounding the hatch. This is typically accomplished by having some portion extend from the framework to the hatch or from the hatch to the framework to engage in an interference type connection, thereby latching the hatch in place.

What is needed in the art is a hatch latching system that holds the hatch in position yet is easily released for opening or closing of the hatch.

SUMMARY OF THE INVENTION

The present invention is directed to a hatch latching system for a sliding hatch and, particularly, for a hatch system associated with a railcar system.

The invention consists, in one form thereof, of a railcar hatch cover latching system including a sliding mechanism and a latching apparatus. The sliding mechanism is attached to a moveable portion of the hatch cover. The latching apparatus is associated with the hatch cover. The latching apparatus includes a biased assembly, a bar, and at least one profiled stop. The bar extends through the biased assembly. The biased assembly is configured to allow the bar to pass through the biased assembly with a first force requirement. The at least one profiled stop is positioned on the bar to encounter the biased assembly and to thereby require a second force requirement to move the bar past the at least one profiled stop. The second force is greater than the first force.

An advantage of the present invention is that the latching system is primarily connected to the moveable hatch for easy assembly/disassembly.

Another advantage of the present invention is that movements of the slideable hatch in directions other than the latching direction do not substantially effect the latching force applied by the biasing assembly.

Another advantage of the present invention is that an automated opening and closing process of a passive nature can be utilized to overcome the latching force to thereby slide the hatch cover to either an open or a closed position.

BRIEF DESCRIPTION OF THE DRAWINGS

The above-mentioned and other features and advantages of this invention, and the manner of attaining them, will become more apparent and the invention will be better understood by reference to the following description of embodiment of the invention taken in conjunction with the accompanying drawings, wherein.

Corresponding reference characters indicate corresponding parts throughout the several views. The exemplifications set out herein illustrates one embodiment of the invention and such exemplifications are not to be construed as limiting the scope of the invention in any manner.

DETAILED DESCRIPTION OF THE INVENTION

Figure 1:
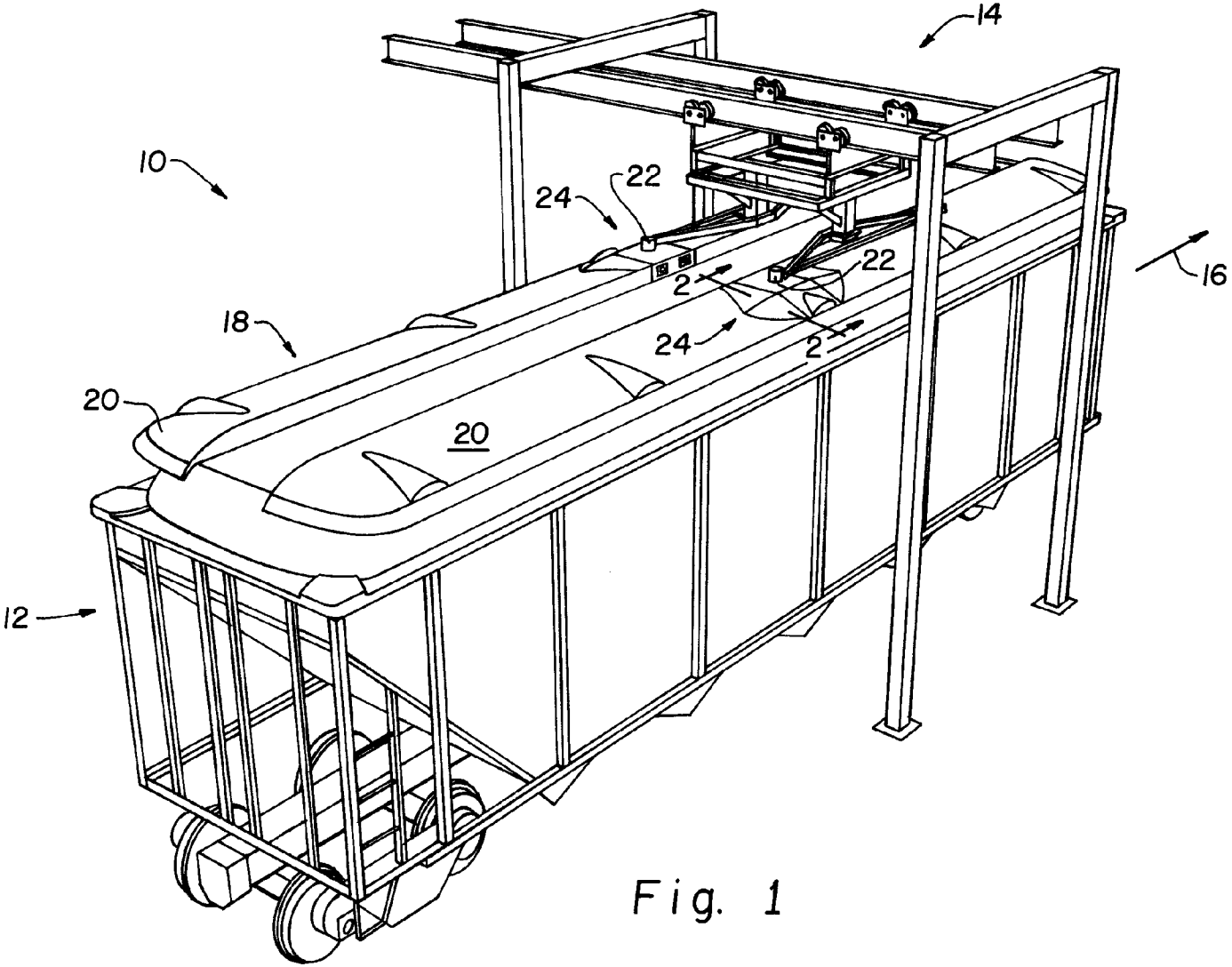
FIG. 1 is a perspective view of a railcar having an embodiment of the hatch latching system of the present invention with a closing device suspended thereover.

Referring now to the drawings, and more particularly to FIG. 1, there is shown a railcar system 10, including a railcar 12, moving by a closing system 14 in direction 16. Cover 18 is being closed as railcar 12 moves in direction 16 by the interaction of elements of the railcar cover and closing system 14. Cover 18 includes sliding hatch covers 20 with protrusions 22, which may be in the form of rollers 22, which encounter structural portions of closing system 14, thereby moving covers 20 toward each other as railcar 12 moves in direction 16.

Now, additionally referring to FIGS. 2-7, there is illustrated latching system 24 that is connected primarily to sliding hatch covers 20 with a bracket 28 connected to cover lower portion 26. Bracket 28 receives a portion of latching system 24 therein, allowing vertical movement in a sliding manner of latching system 24 therein, but restraining lateral movement of the portion of the latching system contained therein.

Latching system 24 additionally includes a biased assembly 30, a bar assembly 32, and an alignment assembly 34. Alignment assembly 34 includes a male portion 36 and a female portion 38 that interact with each other as covers 20 close. In the embodiment illustrated, there are two latching systems 24 for each rail cover 20, one having a male portion 36 and the other having a female portion 38. As can be seen in the figures this allows each railcar 20 to be identically configured and, since one is rotated at 180° relative to the other, the interaction of portions 36 and 38 allow for the engagement of covers 20 in a self-aligning manner as covers 20 are closed.

The male portion 36 has a tapered feature allowing engagement with the female portion 38 to thereby assure alignment between covers 20.

Bar assembly 32 additionally includes a bar 40 having profiled stops 42 connected thereto. Profiled stops 32 are illustrated as having a rounded, triangular profile. However, other profiles are other contemplated and, although symmetrically shown and is utilized as such in the main embodiment, non-symmetrical shapes, such as other triangular configurations and curvilinear shapes are also contemplated. The shape of profiled stops 42 interact with bias assembly 30 to cause the force required to move bar 40 through bias assembly 30 to vary depending upon the interaction of the biasing mechanism, the surface encountering profiled stops 42, as well as the shape of profiled stops 42. Profiled stops 42 are illustrated as being on the topside of bar 40, although other configurations are also contemplated. Generally, profiled stops 42 will have to be oriented in order to properly interact with the biasing features of bias assembly 30.

Biased assembly 30 includes a biased cassette 44 having a lower bearing surface 46, an upper bearing surface 48, springs 50, and an adjustment mechanism 52. Biased cassette 44 is slid into bracket 28, which allows cassette 44 to move up and down in bracket 28 as various vibrations and movements of railcar 12 occurs without significantly altering the latching force provided by cassette 44. Additionally, bar 40 is narrower than the opening in cassette 44, allowing latitude for bar 40 to move side-to-side, again, without altering the latching force provided by the interaction between biased cassette 44 and the combination of bar 40 and profiled stops 42. Bearings 46 and 48 may be rollers having bearings connected to portions of cassette 44, or bearings 46 and 48 may themselves be a rolling sleeve, or bearing surfaces 46 and 48 may be fixed, having inherent sliding features of their own.

Springs 50 bias upper bearing 48 toward lower bearing 46 and may be stopped having a minimum distance therebetween. Bar 40 has a force required to slide it in a longitudinal direction through cassette 44 by way of the force from springs 50 as it is conveyed to bar 40. As cover 20 is moved, profiled stop 42 encounters upper bearing 48, which is part of the biasing features of bias cassette 44, causing a greater force to be required to move bar 40 as profiled stop 42 interacts with the biased nature of bearings 46 and 48 so that a deliberate greater force is required to move cover 20 past stop 42.

Figure 2:
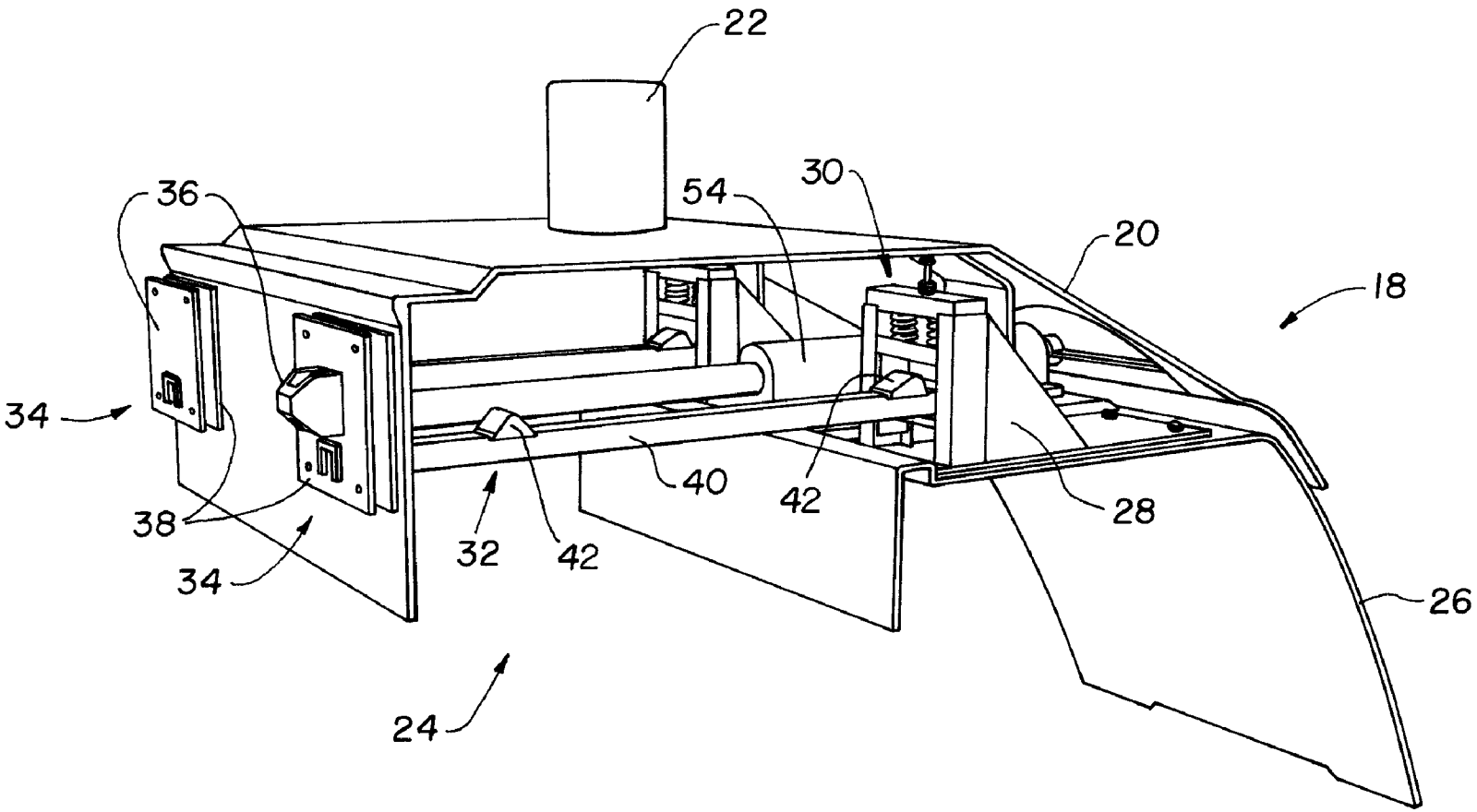
FIG. 2 is a partial cross section of the latching system of FIG. 1 taken along lines 2-2 of FIG. 1.
Figure 3:
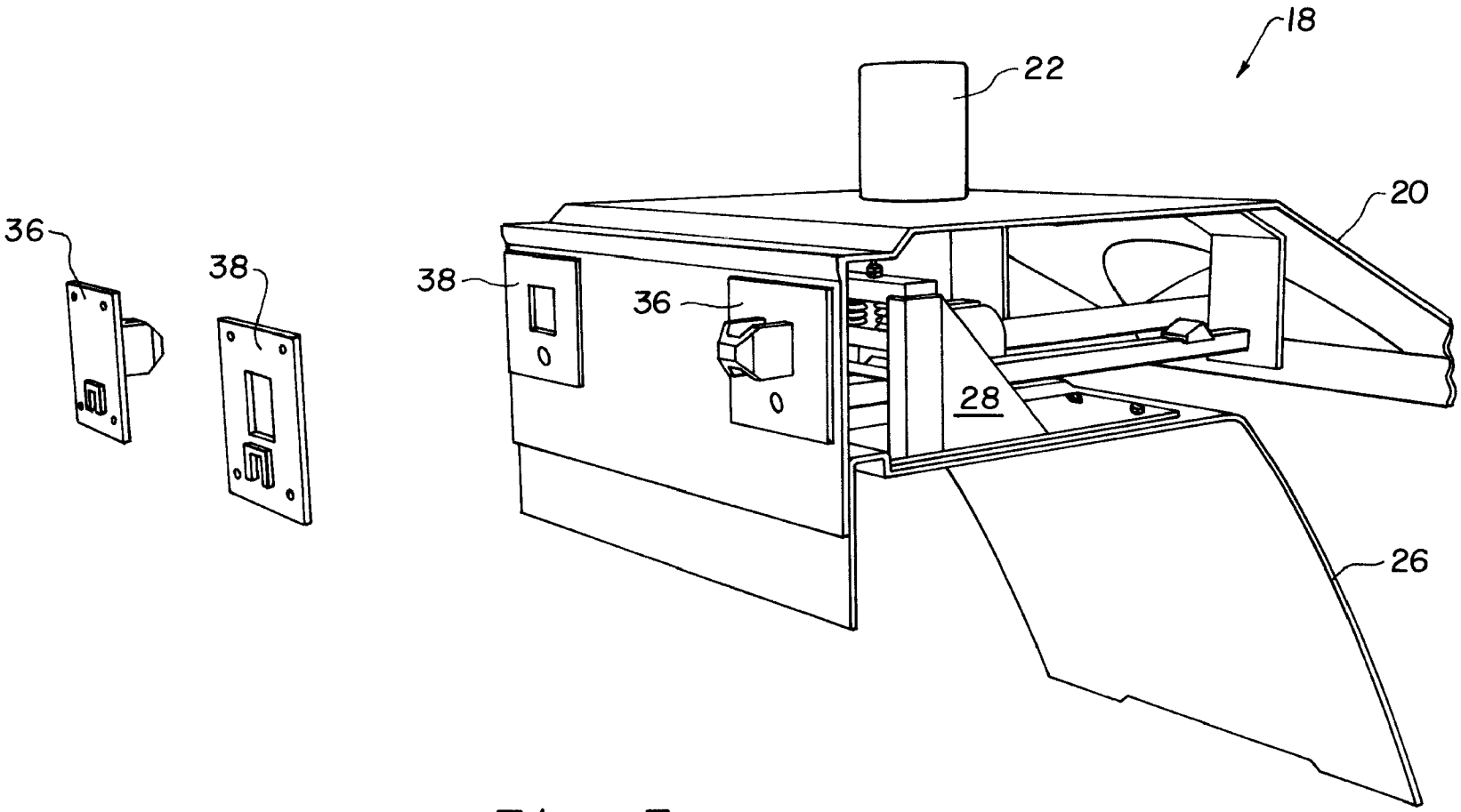
FIG. 3 is the latching system of FIG. 2 with the hatch cover shown in an open position.

As can be seen in FIG. 2, cover 20 is in a closed position with alignment assembly 34 being shown engaged with the opposing reciprocal male and female portions 36 and 38. In FIG. 3, cover 20 has been slid to an open position with alignment portions 36 and 38 being separated with the left set of portions 36 and 38 being shown separated from the complementary portions on the right. Additionally, biased cassette 44 has interacted with the other stop 42 to thereby hold cover 20 in an open position. As shown in FIG. 1, the operation of a mechanism overhead interacts with protrusions 22 to apply force that is translated into linear, or at least quasi-linear, force to open or close hatch covers 20. Linear bearing arrangements 54 may be arranged along each cover 20 to provide stability in the movement of hatch covers 20, allowing latching systems 24 to function as latching systems and not bearing systems. Although these features are separate, it is also contemplated that these features could be combined within the scope of the inventive nature of the present invention. It is also contemplated that although bars 40 are shown as being linear other shapes are also contemplated, such as curved and curvilinear.

Figure 4:
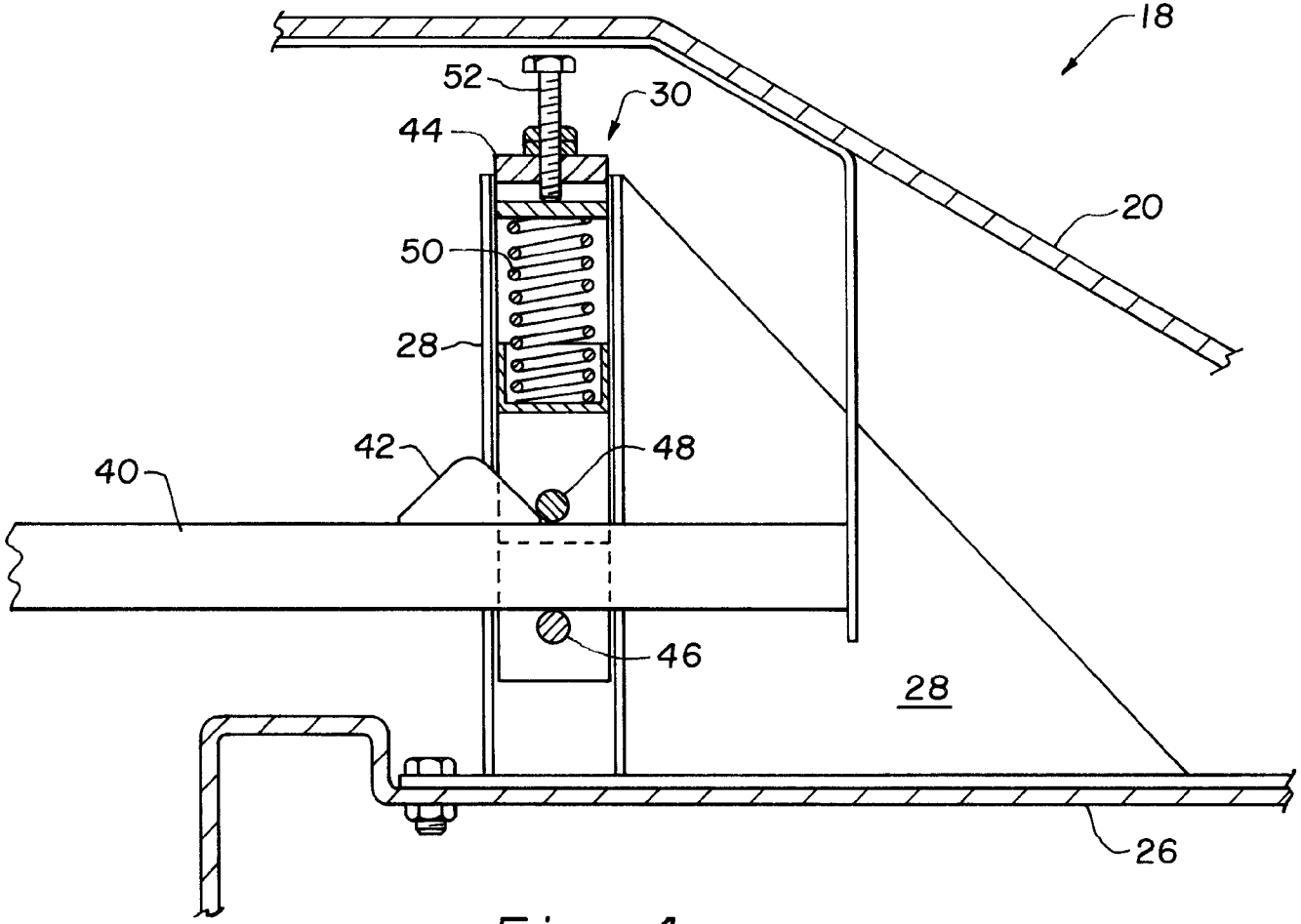
FIG. 4 is another partial cross section showing details of the latching system of FIGS. 1-3.
Figure 5:
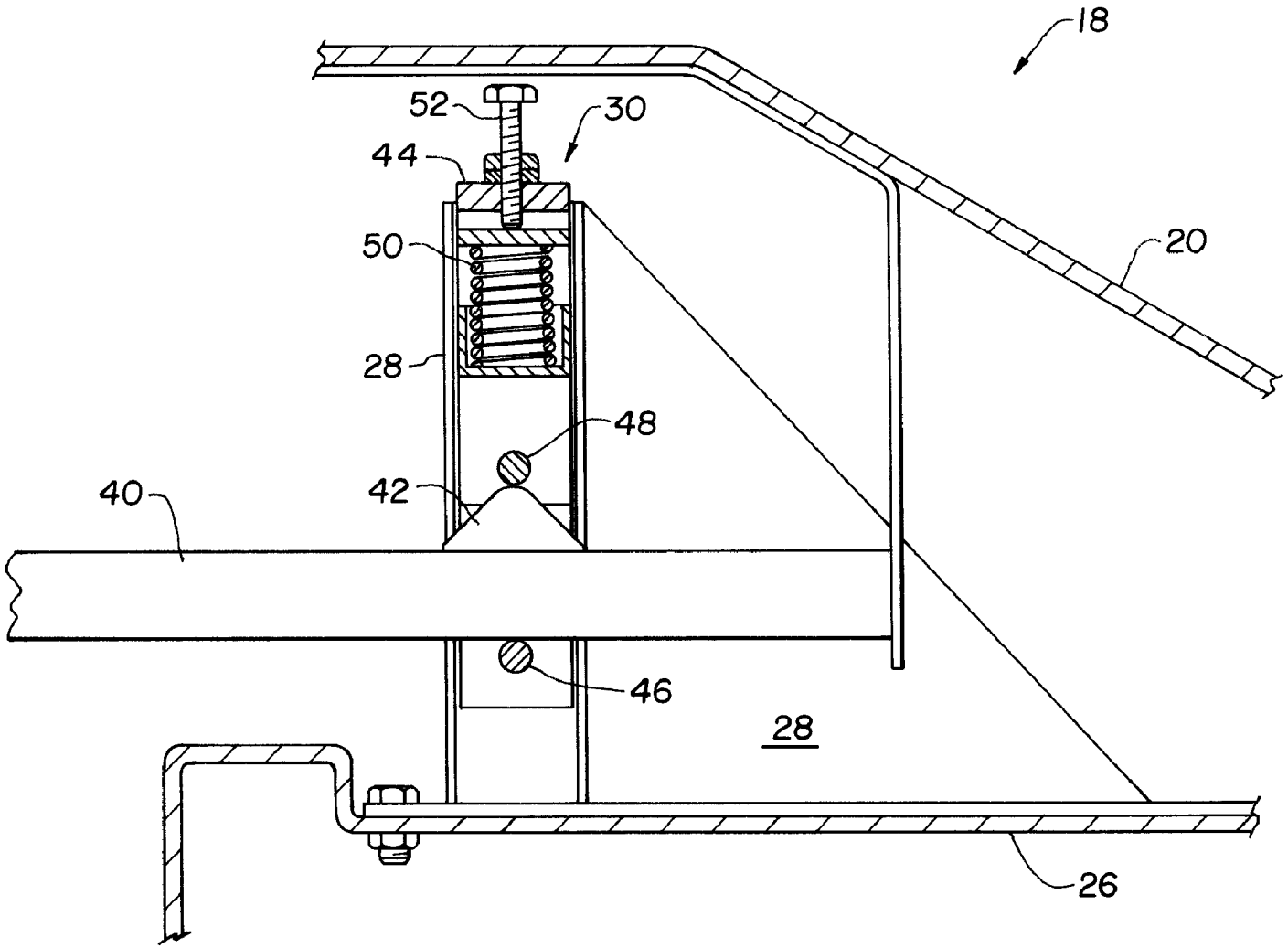
FIG. 5 is another partial cross section of the latching system of FIG. 4 with the latching system being opened past a profiled stop.

As seen in FIG. 4, profiled stop 42 has encountered bearing 48 and the interaction between bearing 46 and 48 hold hatch cover 20 in a closed position relative to lower cover 26. Adjusting mechanism 52 can be utilized to alter the biasing force of springs 50, although it is also contemplated to produce a bias cassette 44 without an adjustment feature 52. It is also contemplated that springs 50 may be non-linear in function, having different compression force requirements based upon the compressed length of spring 50. As bar 40 is pushed to the right, as shown in FIG. 5, with increased force being needed to separate bearings 48 and 46 by the interaction of stop 42, cover 20 is then being moved, if to the right, then to open cover 20, or if being moved to the left, to thereby close cover 20.

Figure 6:
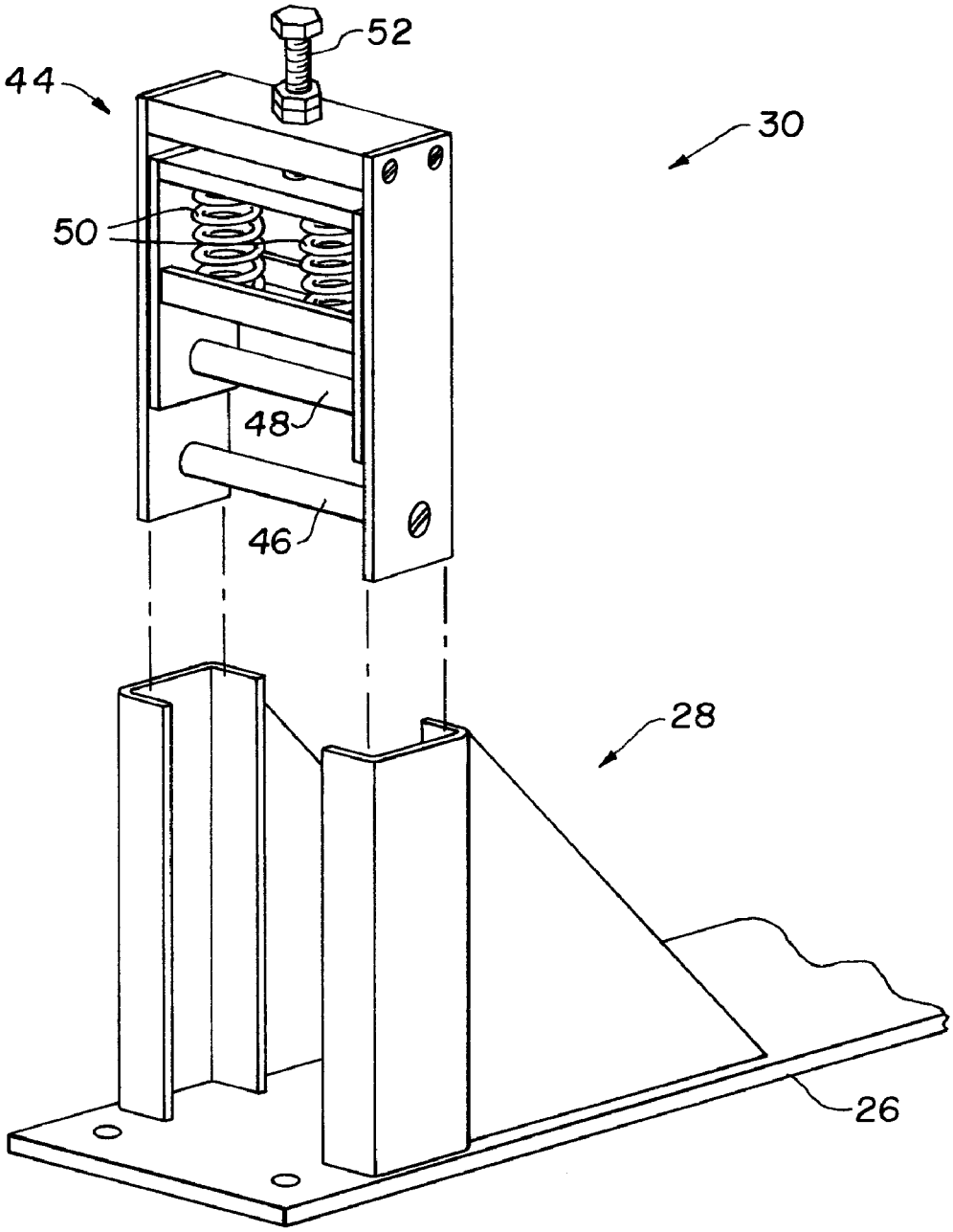
FIG. 6 is a partially exploded view of the biasing mechanism of the hatch latching system of FIGS. 1-5 showing it in conjunction with a bracket that is connected to the lower portion of the hatch cover.

As can be seen in FIG. 6, biased cassette 44 is simply slid into bracket 28. This allows the latching assembly connected to cover 20 to be easily removed without the removal of any fasteners or restraints. This also allows biased cassette 44 to move in a vertical manner to compensate for vibrations and movements as railcar 12 moves from place to place. Additionally, as already mentioned, bar 40 has a width that is substantially narrower than the width of cassette 44, thereby allowing bar 40 to slide in the direction parallel with the longitudinal axis of railcar 12. Bar 40 has a longitudinal axis and profiled stops 42 have a stop axis perpendicular therewith that can be understood to be in the direction in which bearing 48 must move as it overcomes stop 42. This allows cassette 44 to move in bracket 28 in a direction parallel to the stop direction, yet the bracket prevents movement of the cassette in a longitudinal axis direction of bar 40. Bar 40 can move in the direction substantially normal to the stop direction within biased cassette 44.

Applicant's invention provides for sliding a bar through the biasing assembly 30 with a first force until encountering the profiled stop 42 connected to bar 40. Continued sliding of bar 40 past stop 42 requires a second force, the second force being greater than the first force. Although it is understood that it is profiled step 42 that passes between biased cassette 44's bearings 46 and 48 that the force is reduced once it reaches the top of profiled stop 42.

Figure 7:
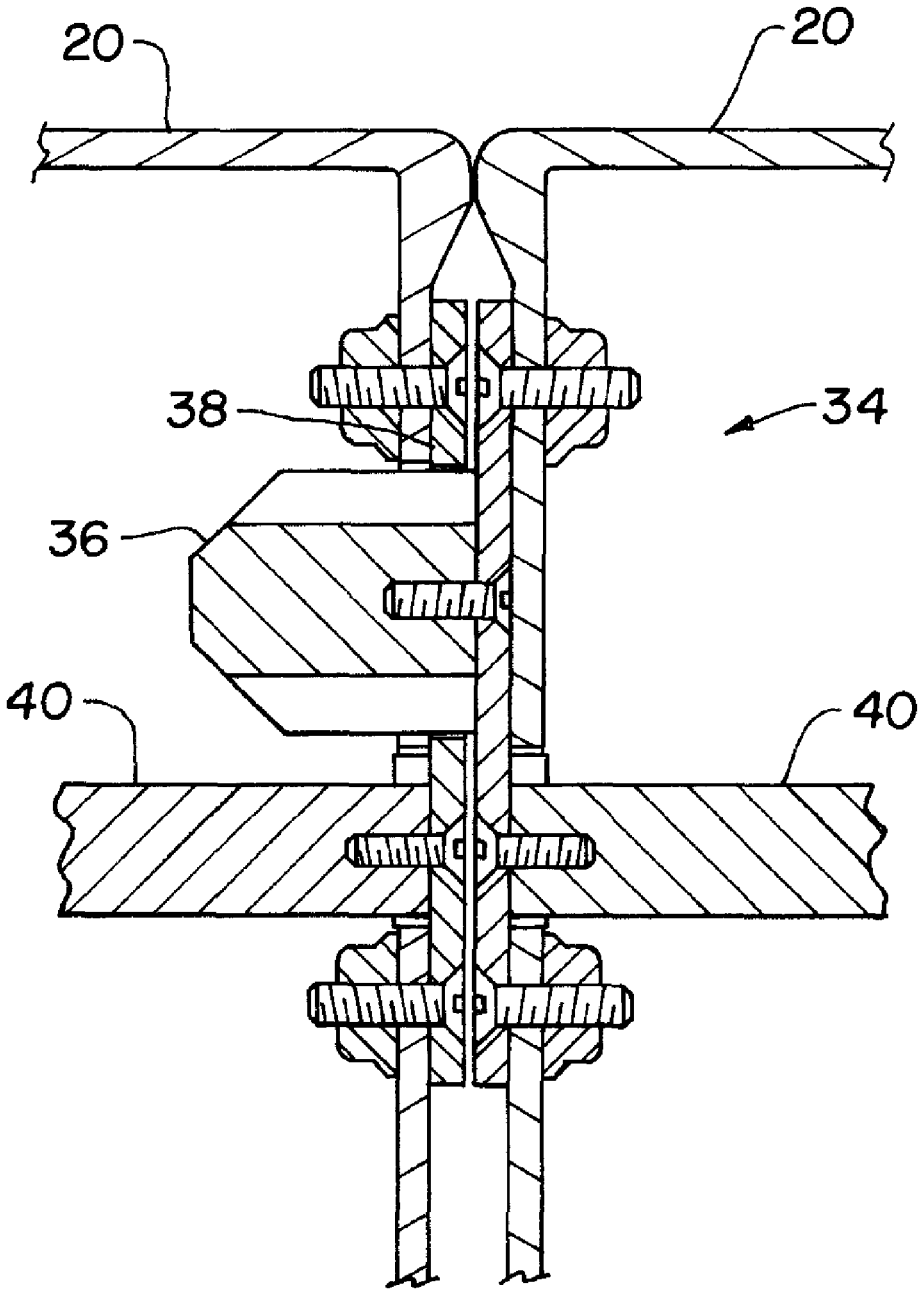
FIG. 7 is a view of a distal end of the hatch cover latching system of FIGS. 1-6.

Now, referring to FIG. 7, there is shown distal ends of bars 40 with aligning assembly 34 in an engaged position with portions 36 and 38 showing the alignment of covers 20 in a closed position. No latching between covers 20 occurs with the actual latching occurring within each cover and alignment assembly 34 is used for final alignment of covers 20 as they approach each other.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A railcar hatch cover latching system, comprising:

a sliding mechanism attached to a movable portion of the hatch cover; and a latching apparatus associated with the hatch cover, the latching apparatus including:

a biased assembly;

a bar extending through said biased assembly, said biased assembly being configured to allow said bar to pass through said biased assembly with a first force requirement; and at least one profiled stop positioned on said bar to encounter said biased assembly and having a second force requirement to move said at least one profiled stop, past said biased assembly said second force being greater than said first force.

2. The railcar hatch cover latching system, of claim 1, wherein said at least one profiled stop includes a first profiled stop and a second profiled stop, said first profiled stop being positioned on said bar at a first position proximate to said biased assembly when the hatch cover is in a closed position, said second profiled stop being positioned on said bar at a second position proximate to said biased assembly when the hatch cover is in an opened position.

3. The railcar hatch cover latching system of claim 2, wherein said first profiled stop is on one side of said biased assembly when the hatch cover is in said closed position and said second profiled stop is on an opposite side of said biased assembly when the hatch cover is in said opened position.

4. The railcar hatch cover latching system of claim 2, wherein said first profiled stop and said second profiled stop each have substantially similar symmetric profiles.

5. The railcar hatch cover latching system of claim 1, further comprising a bracket attached to a fixed portion of the hatch cover, said biased assembly being slidingly engaged in said bracket.

6. The railcar hatch cover latching system of claim 5, wherein said bar has a longitudinal axis defining a longitudinal axis direction, said at least one profiled stop extending from one side of said bar in a stop direction, said biased assembly being configured to allow sliding movement of said bar in a direction that is substantially normal to said axis and said stop direction.

7. The railcar hatch cover latching system of claim 6, wherein said bracket allows said biased assembly to slide in a direction parallel to said stop direction, said bracket preventing said biased assembly from moving in said longitudinal axis direction.

8. A latching system for use with a hatch cover, the latching system being attached to a movable portion of the hatch cover, the latching system comprising:

a biased assembly;

a bar extending through said biased assembly, said biased assembly being configured to allow said bar to pass through said biased assembly with a first force requirement; and at least one profiled stop positioned on said bar to encounter said biased assembly and having a second force requirement to move said at least one profiled stop, past said biased assembly said second force being greater than said first force.

9. The latching system, of claim 8, wherein said at least one profiled stop includes a first profiled stop and a second profiled stop, said first profiled stop being positioned on said bar at a first position proximate to said biased assembly when the hatch cover is in a closed position, said second profiled stop being positioned on said bar at a second position proximate to said biased assembly when the hatch cover is in an opened position.

10. The latching system of claim 9, wherein said first profiled stop is on one side of said biased assembly when the hatch cover is in said closed position and said second profiled stop is on an opposite side of said biased assembly when the hatch cover is in said opened position.

11. The latching system of claim 9, wherein said first profiled stop and said second profiled stop each have substantially similar symmetric profiles.

12. The latching system of claim 8, further comprising a bracket attached to a fixed portion of the hatch cover, said biased assembly being slidingly engaged in said bracket.

13. The latching system of claim 12, wherein said bar has a longitudinal axis defining a longitudinal axis direction, said at least one profiled stop extending from one side of said bar in a stop direction, said biased assembly being configured to allow sliding movement of said bar in a direction that is substantially normal to said axis and said stop direction.

14. The latching system of claim 13, wherein said bracket allows said biased assembly to slide in a direction parallel to said stop direction, said bracket preventing said biased assembly from moving in said longitudinal axis direction.

* * * * *